US009446590B2

(12) United States Patent
Chen et al.

(10) Patent No.: US 9,446,590 B2
(45) Date of Patent: Sep. 20, 2016

(54) DIAGONAL OPENINGS IN PHOTODEFINABLE GLASS

(75) Inventors: Chien-Hua Chen, Corvallis, OR (US); Silam J. Choy, Corvallis, OR (US); Brett E. Dahlgren, Albany, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/421,975

(22) PCT Filed: Aug. 16, 2012

(86) PCT No.: PCT/US2012/051150

§ 371 (c)(1),
(2), (4) Date: Feb. 16, 2015

(87) PCT Pub. No.: WO2014/028022

PCT Pub. Date: Feb. 20, 2014

(65) Prior Publication Data

US 2015/0210074 A1 Jul. 30, 2015

(51) Int. Cl.

| | |
|---|---|
| ***B41J 2/14*** | (2006.01) |
| ***B41J 2/16*** | (2006.01) |
| ***B41J 27/20*** | (2006.01) |

(52) U.S. Cl.

CPC ..... *B41J 2/1433* (2013.01); *B41J 2/14145* (2013.01); *B41J 2/1603* (2013.01); *B41J 2/1623* (2013.01); *B41J 2/1629* (2013.01); *B41J 2/1634* (2013.01); *B41J 27/20* (2013.01); *B41J 2002/14419* (2013.01); *Y10T 428/24314* (2015.01)

(58) Field of Classification Search

CPC ..... B41J 2/1433; B41J 27/20; B41J 2002/14419; B41J 2/1631; B41J 2/1623; B41J 2/162; B41J 2202/22; B41J 2/14201

See application file for complete search history.

(56) References Cited

U.S. PATENT DOCUMENTS

| | | | | |
|---|---|---|---|---|
| 4,390,391 | A | 6/1983 | Fujita et al. | |
| 5,028,514 | A | 7/1991 | Johannsen | |
| 6,479,395 | B1 | 11/2002 | Smith et al. | |
| 7,337,540 | B2 * | 3/2008 | Kurosawa | B32B 15/04 217/27 |
| 7,828,417 | B2 * | 11/2010 | Haluzak | B41J 2/16 347/49 |
| 2009/0013724 | A1 * | 1/2009 | Koyo | B23K 26/0093 65/31 |
| 2011/0195360 | A1 * | 8/2011 | Flemming et al. | 430/314 |
| 2012/0120682 | A1 * | 5/2012 | Sasagawa et al. | 362/624 |
| 2012/0135606 | A1 * | 5/2012 | Shimoi | B23K 26/381 438/705 |

FOREIGN PATENT DOCUMENTS

| | | |
|---|---|---|
| JP | 6227843 | 8/1994 |
| JP | 2000053446 | 2/2000 |

(Continued)

OTHER PUBLICATIONS

English translation of JP 2001-085167.*

*Primary Examiner* — Julian Huffman
*Assistant Examiner* — Michael Konczal
(74) *Attorney, Agent, or Firm* — Rathe Lindenbaum LLP

(57) ABSTRACT

In one example, a method for making diagonal openings in photodefinable glass includes exposing part of a body of photodefinable glass to a beam of light oriented diagonally to a surface of the body at an angle of 5° or greater measured with respect to a normal to the surface of the body and removing some or all of the part of the body exposed to the light beam to form a diagonal opening in the body.

10 Claims, 10 Drawing Sheets

(56) References Cited

FOREIGN PATENT DOCUMENTS

| | | | | |
|---|---|---|---|---|
| JP | 2001085167 | A | | 3/2001 |
| JP | 2001085167 | A | * | 3/2001 |
| JP | 2005190857 | | | 7/2005 |
| JP | 2006035453 | | | 2/2006 |
| JP | 2009116127 | A | | 5/2009 |
| JP | 2010024064 | A | * | 2/2010 |
| JP | 2011128253 | A | | 6/2011 |
| JP | 2011178010 | A | * | 9/2011 |
| JP | 2012027493 | A | | 2/2012 |
| JP | 2012035294 | A | | 2/2012 |

* cited by examiner

DIAGONAL OPENINGS IN PHOTODEFINABLE GLASS

BACKGROUND

Each printhead die in an inkjet pen or print bar includes tiny slots that channel ink to the ejection chambers. Ink is distributed from the ink supply to the die slots through passages in a structure that supports the printhead die(s) on the pen or print bar. It may be desirable to shrink the size of each printhead die, for example to reduce the cost of the die and, accordingly, to reduce the cost of the pen or print bar.

DRAWINGS

The same part numbers designate the same or similar parts throughout the figures.

DESCRIPTION

Figure 1:
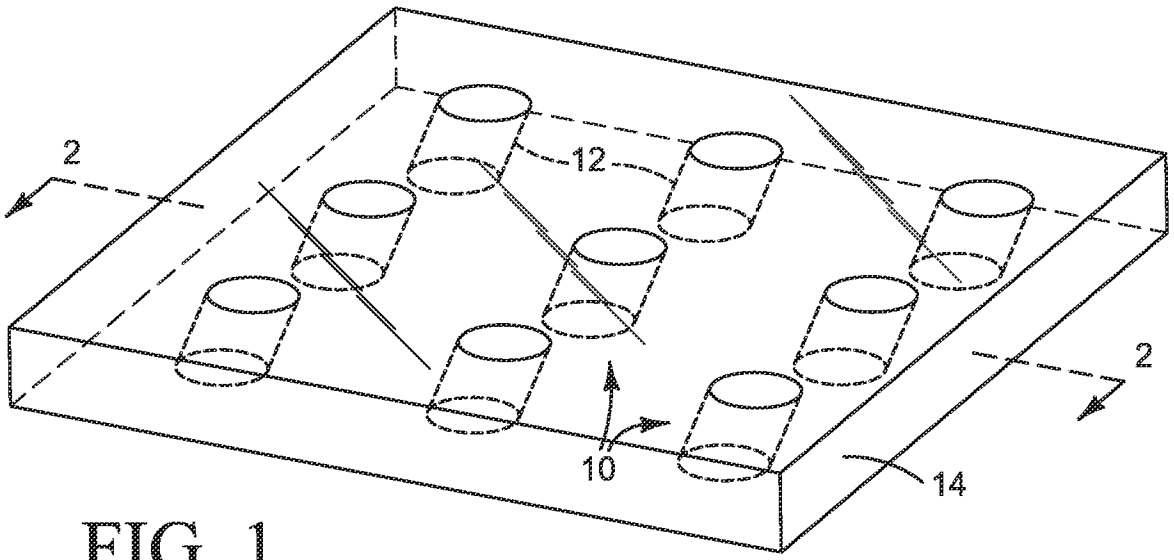
FIGS. 1 and 2 illustrate one example of an array of diagonally oriented openings in a photodefinable glass plate in which circular openings in a uniform pattern are oriented at the same angle.
Figure 2:
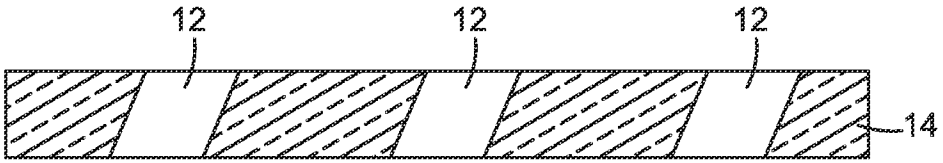
Figure 3:
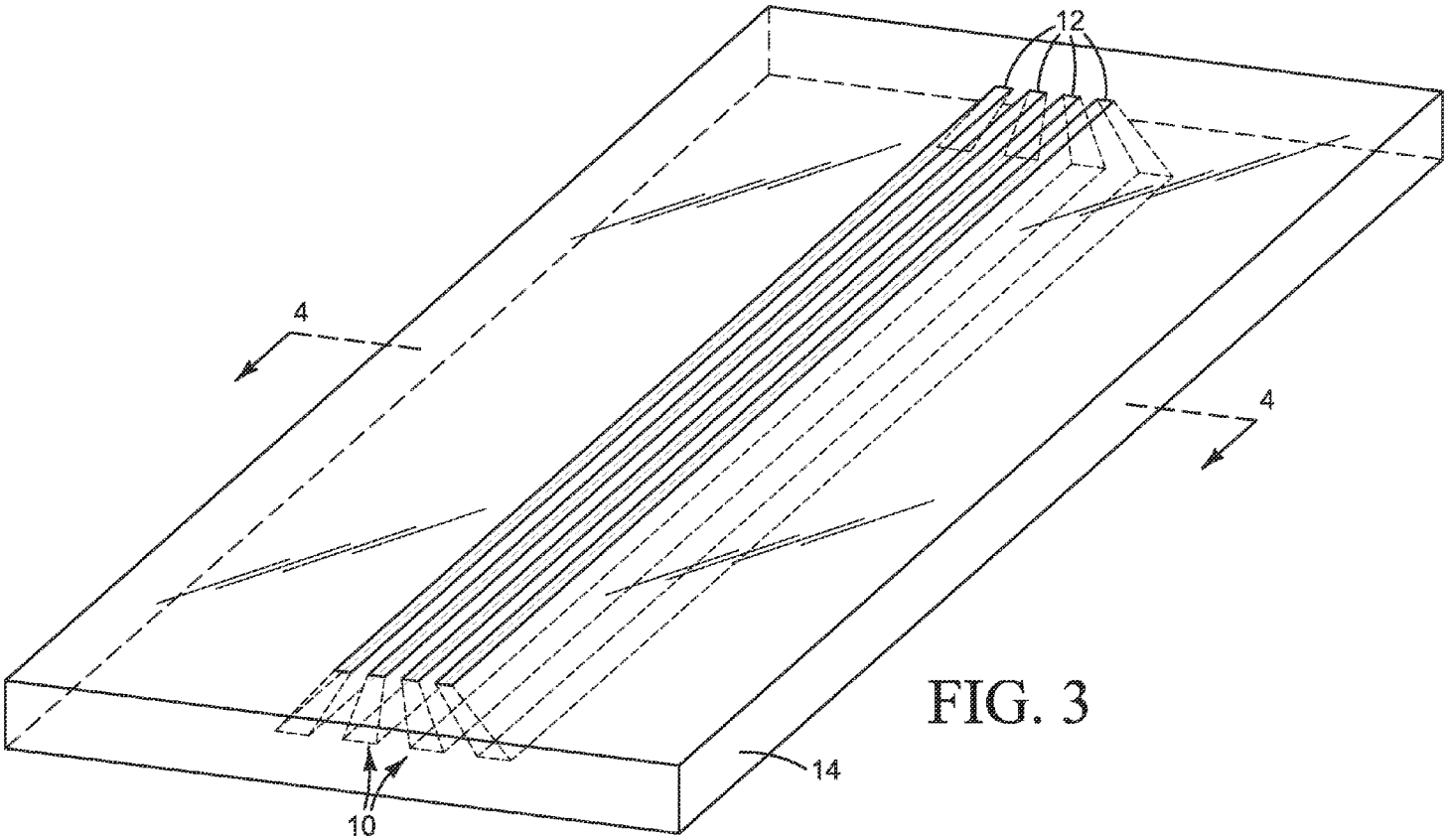
FIGS. 3 and 4 illustrate another example of an array of diagonally oriented openings in a photodefinable glass plate in which slots in a fanned out pattern are oriented at different angles.
Figure 4:
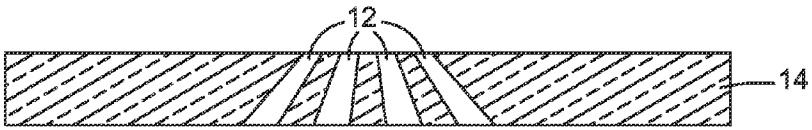
Figure 5:
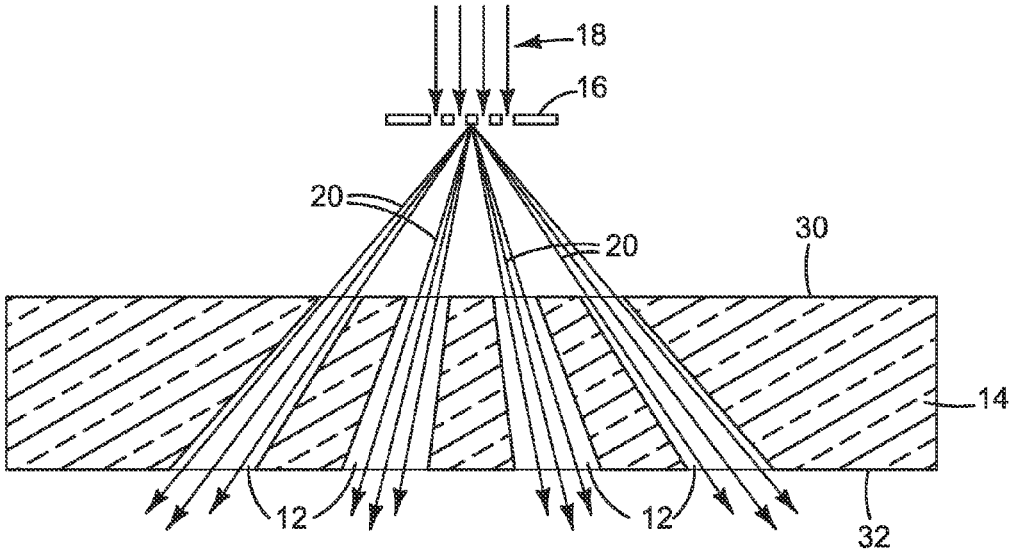
FIGS. 5-9 illustrate example exposure systems that might be used to form diagonal slots.

Increasing the number of inkjet printhead dies that can be fabricated from a single wafer by shrinking the size of each die can significantly reduce the cost of the dies. The use of smaller dies, however, can require changes to the larger structures that support the dies on the pen or print bar, including the passages that distribute ink to the dies. For example, injection molded distribution manifolds are currently limited to a slot-to-slot spacing of about 800 μm while new printhead dies are being developed with a tighter slot spacing of 500 μm or less. Also, injection molded parts are not very flat, requiring thick adhesive layers for good bonding, which further limits die shrink.

It has been discovered that very small diagonal openings can be precisely formed in photodefinable glass so that small glass plates can be used effectively as interposers with fan-out ink slots to support printhead dies with a tighter slot spacing. U.S. Pat. No. 7,288,417 shows fan-out, expanding ink slots in a glass interposer that the inventors therein "believed" could be formed using glass machining techniques such as sand blasting, laser ablation, molding, and mechanical drilling. (Referring to column 8, lines 5-13 and FIG. 6 of the '417 Patent.) This belief, however, has proved to be misplaced, at least for the fabrication of glass interposers on the very small scale needed for use in inkjet printheads. Unlike conventional glass machining, laser ablation and etching techniques which thus far have been inadequate for fabricating a suitable fan-out glass interposer, the current development of new exposure techniques for photodefinable glass suggests batch processing can be used to cost effectively produce glass fan-out interposers desirable for supporting further printhead die shrink. In addition to supporting tight slot spacing, photodefinable glass interposers can be made very flat, allowing the use of thin adhesive layers, and glass is a good CTE (coefficient of thermal expansion) match for the silicon printhead dies to minimize stress at the die bond interface.

In one example exposure method, a mask or lens (or both) is used to separate a collimated light beam into multiple smaller beams and direct those beams toward a photodefinable glass plate to expose the glass at the desired diagonal. The exposed part of the glass is then removed to form diagonal openings in the glass. In one specific implementation that might be used as an ink slot interposer for a printhead die, multiple slots extending diagonally through the glass plate are formed in a fan-out pattern in which the slot spacing is tighter at one surface of the plate (which would attach to the printhead die) and looser at the opposite surface of the plate (which would attach to the pen body or print bar).

Examples are not limited to implementation as interposers or in printhead dies, but might also include implementations as substrates or other components and in other types of devices. Accordingly, these and other examples shown in the figures and described below illustrate but do not limit the invention, which is defined in the Claims following this Description.

As used in this document, "photodefinable glass" means glass in which openings may be formed by exposing the glass to light and then removing parts of the glass exposed to the light without using machining techniques like sand blasting, laser ablation, molding, or mechanical drilling. Photodefinable glasses include, for example, Foturan™ glass manufactured by the Schott Glass Corp and Apex™ glass manufactured by Life Biosciences, Inc. Some photodefinable glass is also referred to as photosensitive glass or photostructurable glass or glass ceramic.

Also, as used in this document, "liquid" means a fluid not composed primarily of a gas or gases, and a "printhead" means that part of an inkjet printer or other inkjet type dispenser that dispenses liquid from one or more openings. A "printhead" is not limited to printing with ink but also includes inkjet type dispensing of other liquids and/or for uses other than printing.

Referring to FIGS. 1-4, an array 10 of openings 12 are formed in a photodefinable glass plate 14. In the examples shown, each opening 12 extends all the way through plate 10, as a circular hole in the example of FIGS. 1-2 and as an expanding rectilinear slot in the example of FIGS. 3-4. Although openings 12 through the glass plate are shown in the figures, diagonal openings 12 into but not through plate 10 may be desired for some applications. Also, although photodefinable glass structuring techniques could possibly be used to form larger scale structures, an important utility for such techniques lies in the formation of very small "micro" structures for which machining processes are ineffective or impractical. Thus, while no scale is indicated in FIGS. 1-4, it is expected that diagonal openings 12 usually will be 50 μm to 1,000 μm in width formed in a glass plate 14 0.5 mm to 2 mm thick.

In the past, straight openings have been formed perpendicular to the surface of a photodefinable glass plate for microfluidic structures for MEMS (micro electro mechanical systems) applications and as arrays of through glass vias (TGVs) for integrated circuit packaging. Straight copper filled TGVs have been used to form electrical interconnects between the top and bottom of a photodefinable glass interposer, with redistribution layers added to the glass TGV to make an electrical fan out structure. It has been discovered that fan out structures can be formed in the photodefinable glass itself with new exposure techniques using structured lighting (projecting light with known spatial and angular constraints). Not only are diagonal openings possible with the new exposure techniques, but individual openings can be made to expand significantly through the glass and at different diagonals from other openings.

FIGS. 5-9 illustrate several example exposure systems that might be used to form diagonal fan out openings 12. The tilt angle and width of individual light beams that illuminate the glass can be controlled, for example, by wavelength, mask opening size, shape, spacing and phase angle. In the exposure system of FIG. 5, a phase shifting mask or diffraction grating 16 is used to illuminate glass plate 14 in the desired pattern for openings 12. For a phase mask 16, coherent wave fronts in a collimated light beam 18 from a laser or other suitable light source will encounter different indices of refraction at different locations due to steps formed in the mask. The wave fronts interfere to form the desired pattern of light beams 20 that illuminate glass plate 14. For a diffraction grating 16, the periodic structure splits and diffracts collimated source beam 18 into multiple beams 20 travelling in different directions. The directions of beams 20 depend on the spacing of the slits in the grating and the wavelength of the light.

Figure 6:
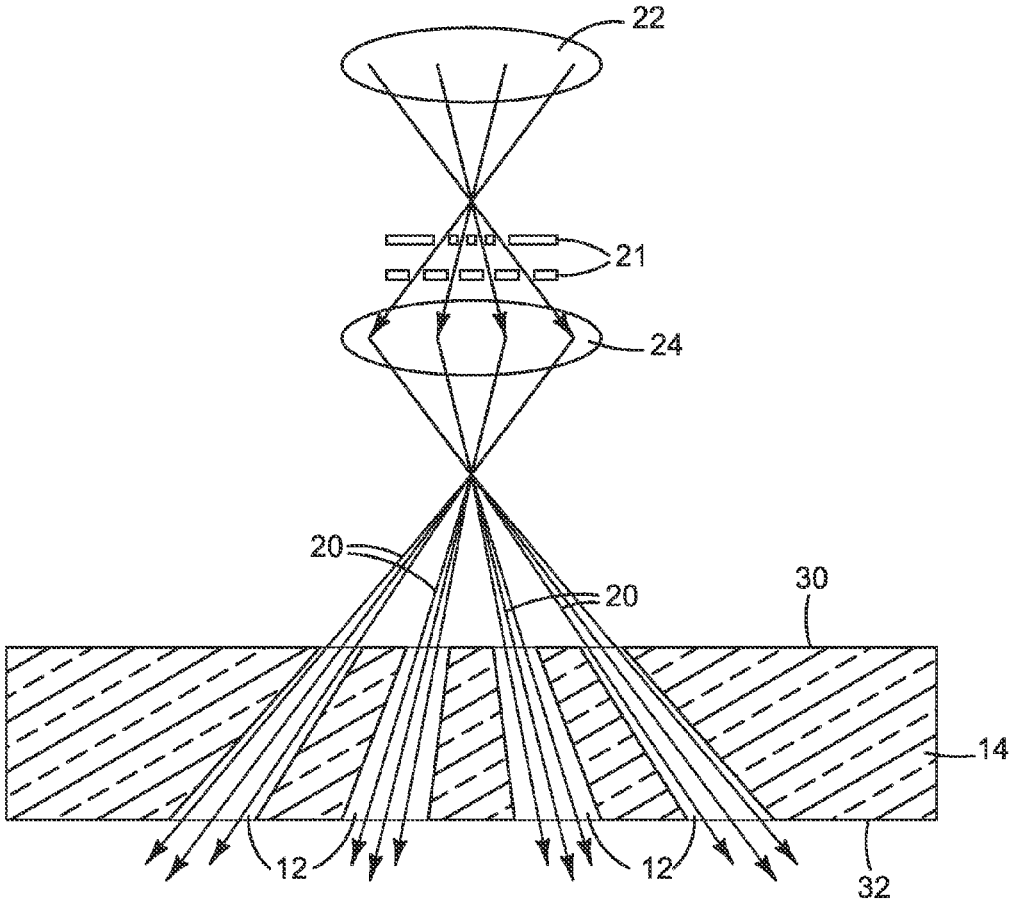
Figure 7:
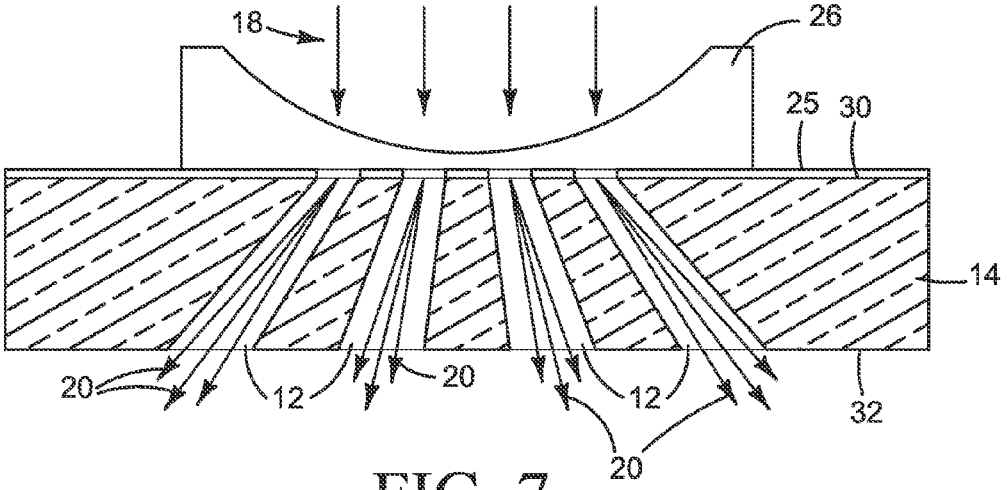
Figure 8:
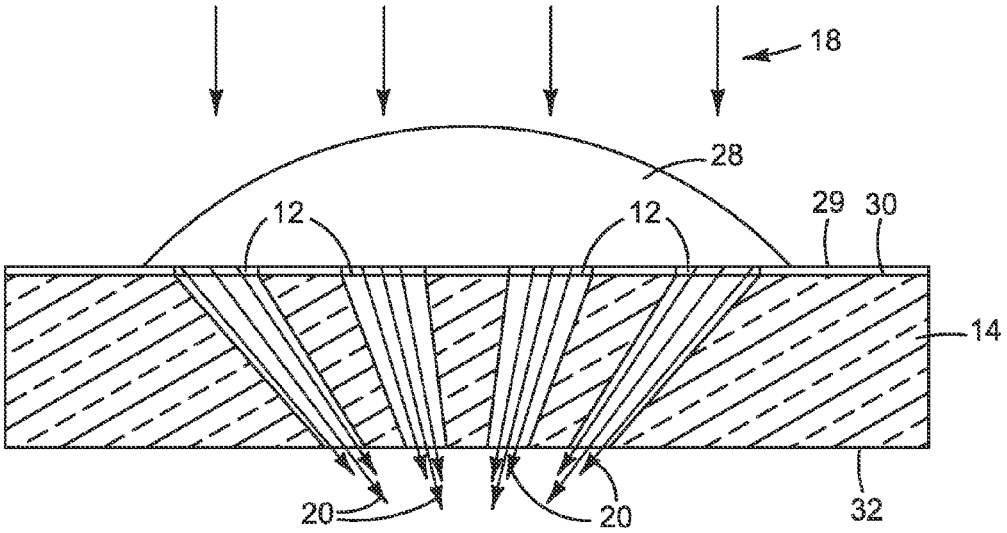
Figure 9:
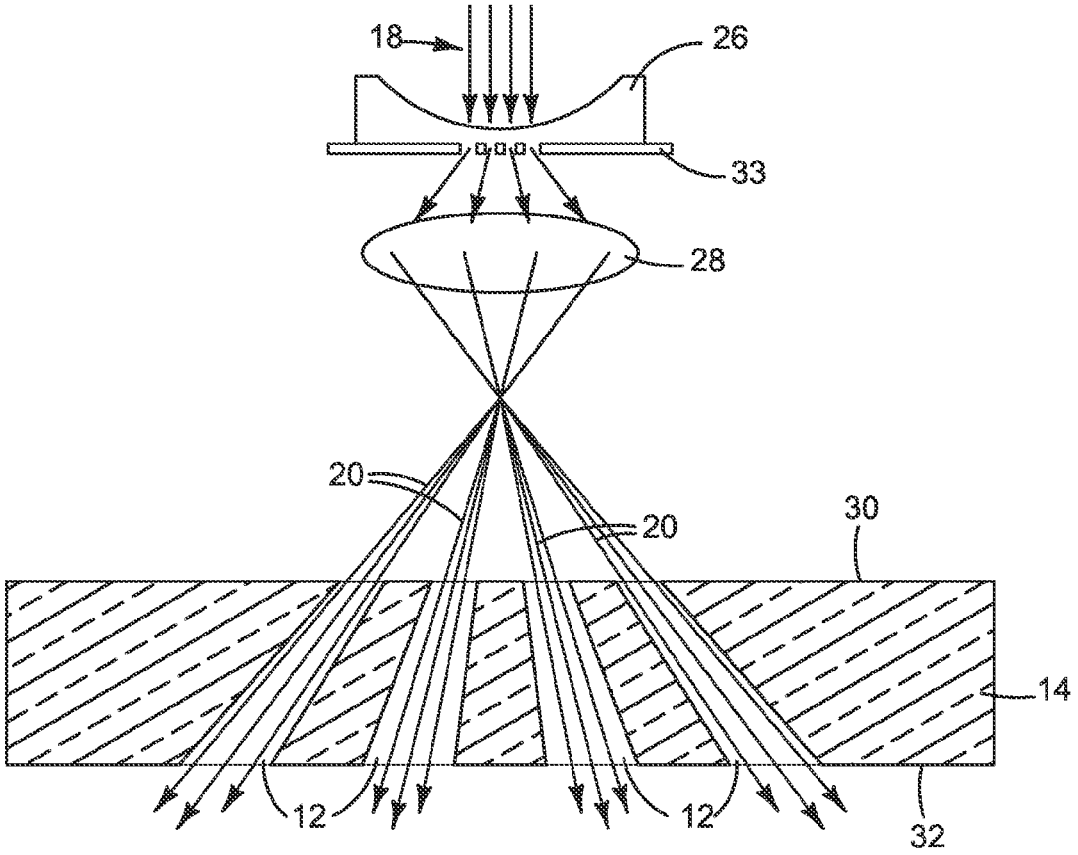

In the exposure system of FIG. 6, a two sided mask 21 imaged to the front and back surfaces of the mask is used with lenses 22, 24 to focus non-collimated light into light beams 20 directed on to glass plate 14 in the desired pattern. The NA (numerical aperture) of the system must be large enough to cover the desired angles of beams 20 while still controlling cross-talk between the openings 12. In the exposure systems of FIGS. 7 and 8, a contact mask 25 is used with a negative cylindrical lens 26 (FIG. 7) or a positive cylindrical lens 28 on or above a surface mask 29 (FIG. 8) to direct beams 20 from a collimated light beam 18 on to glass plate 14 in the desired pattern. In the example shown in FIG. 7, expanding light beams 20 diverge at different angles to pattern openings 12 that fan out and enlarge from front surface 30 to back surface 32. In the example shown in FIG. 8, contracting light beams 20 converge at different angles to pattern openings 12 that converge and contract from front surface 30 to back surface 32. In the exposure system of FIG. 9, an imaged mask 33 with negative and positive lenses 26, 28 simultaneously images two focal planes to direct beams 20 from a collimated light beam 18 on to glass plate 14 in the desired pattern.

Figure 10:
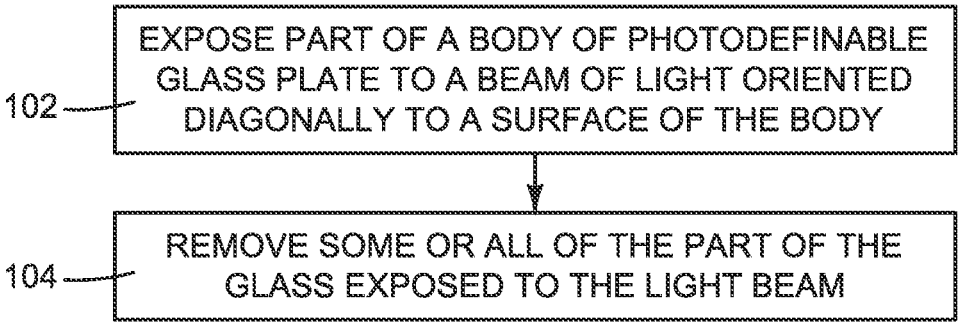
FIGS. 10 and 11 are flow charts illustrating two examples methods for making diagonal openings in a photodefinable glass plate.

Referring to FIG. 10, a method for making a diagonal opening 12 includes exposing part of a body of photodefinable glass (e.g., glass plate 14) to a beam of light oriented diagonally to a surface of the body (step 102) and then removing some or all of the part of the glass exposed to the light beam (step 104). In a more specific example method shown in FIG. 11, a glass plate 14 is exposed to multiple light beams 20 each oriented at a different angle in the range of 5° to 50° measured with respect to a normal to the front surface 30 of plate 14 (step 110). The value for an angle or range of angles as used in this document means the angle or range includes the value(s) without regard to the direction in which the angle is measured from a reference. Thus, an angle in the range of 5° to 50° means +5° to +50° and −5° to −50° where, for example, "+" indicates the angle is measured clockwise from a normal to front surface 30 and "−" indicates the angle is measured counterclockwise from a normal to front surface 30. As shown in FIGS. 5-9, the front surface 30 of plate 14 refers to the surface facing the light beam 20 during illumination and the back surface 32 of plate 14 refers to the surface opposite front surface 30. Glass plate 14 is then heated to change the composition of the exposed part of the glass to a ceramic or other material that can be etched preferentially with respect to the unexposed part of the glass (step 112), and then glass plate 14 is etched to remove some or all of the ceramic part of the plate 14 (step 114).

Figure 11:
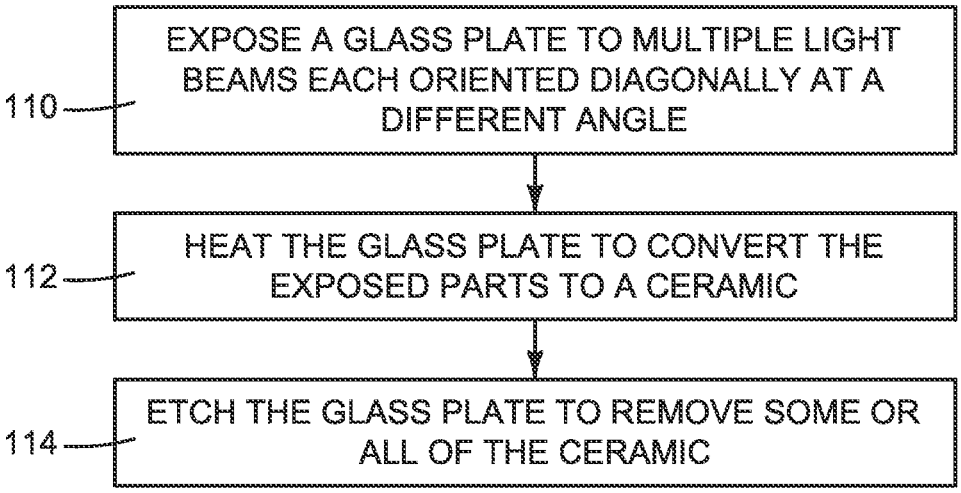

In one example, the following parameters may be applied to the method of FIG. 11 for a 0.5 mm-1.0 mm thick photodefinable glass plate such as Apex™ glass.

Exposing: 10.0-24.0 J/cm2 at 310 nm (mid-wavelength UV light).

Heating: bake at 500° C. for 75 minutes at 6° C. minimum ramp rate and then bake at 575° C. for 75 minutes at 3° C. minimum ramp rate.

Etching: 10:1 mix of water and 49% hydrofluoric acid in an ultrasonic bath.

Figure 12:
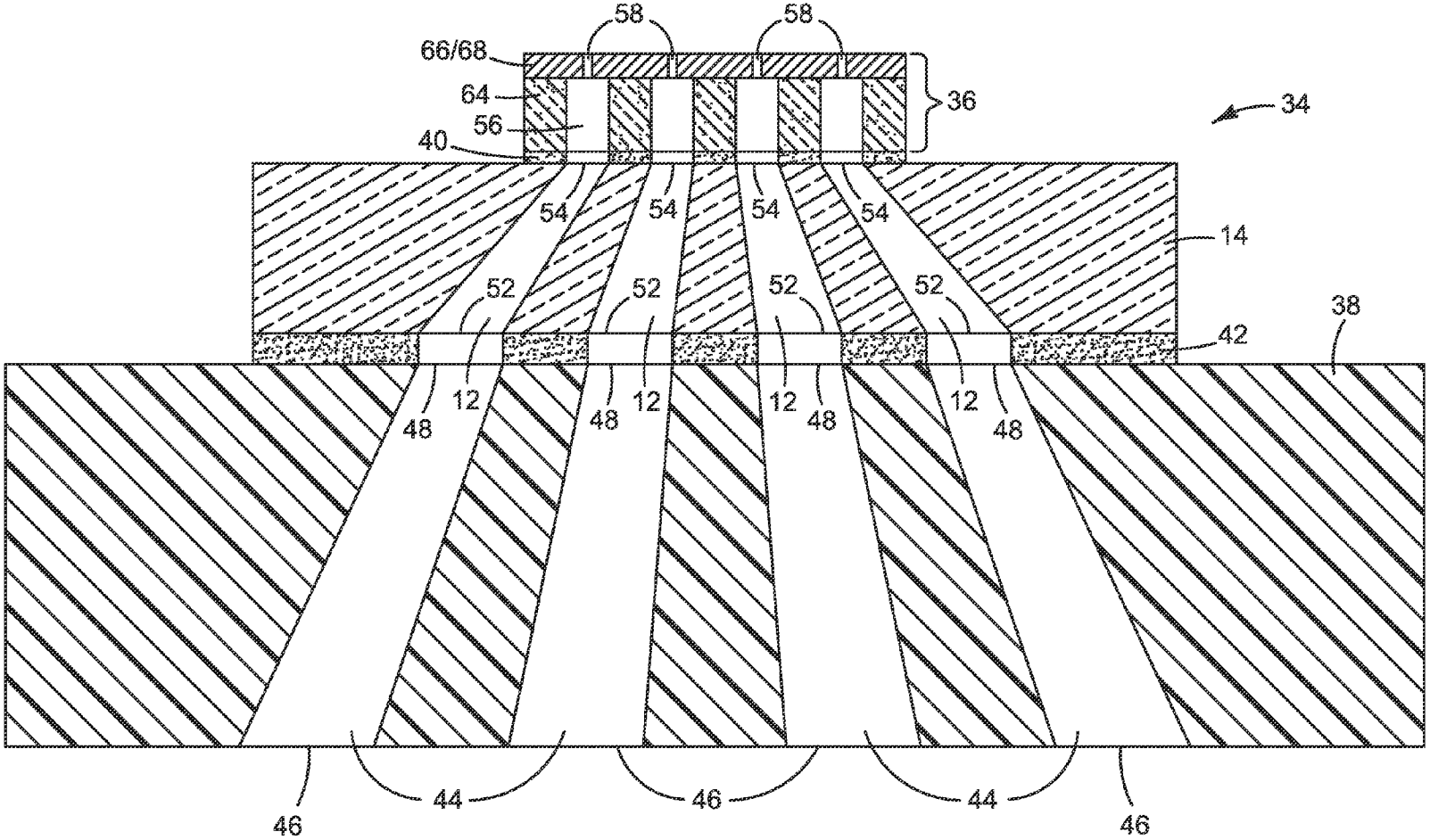
FIGS. 12 and 13 illustrate an inkjet printhead assembly implementing one example of the new diagonal openings in a photodefinable glass interposer.
Figure 13:
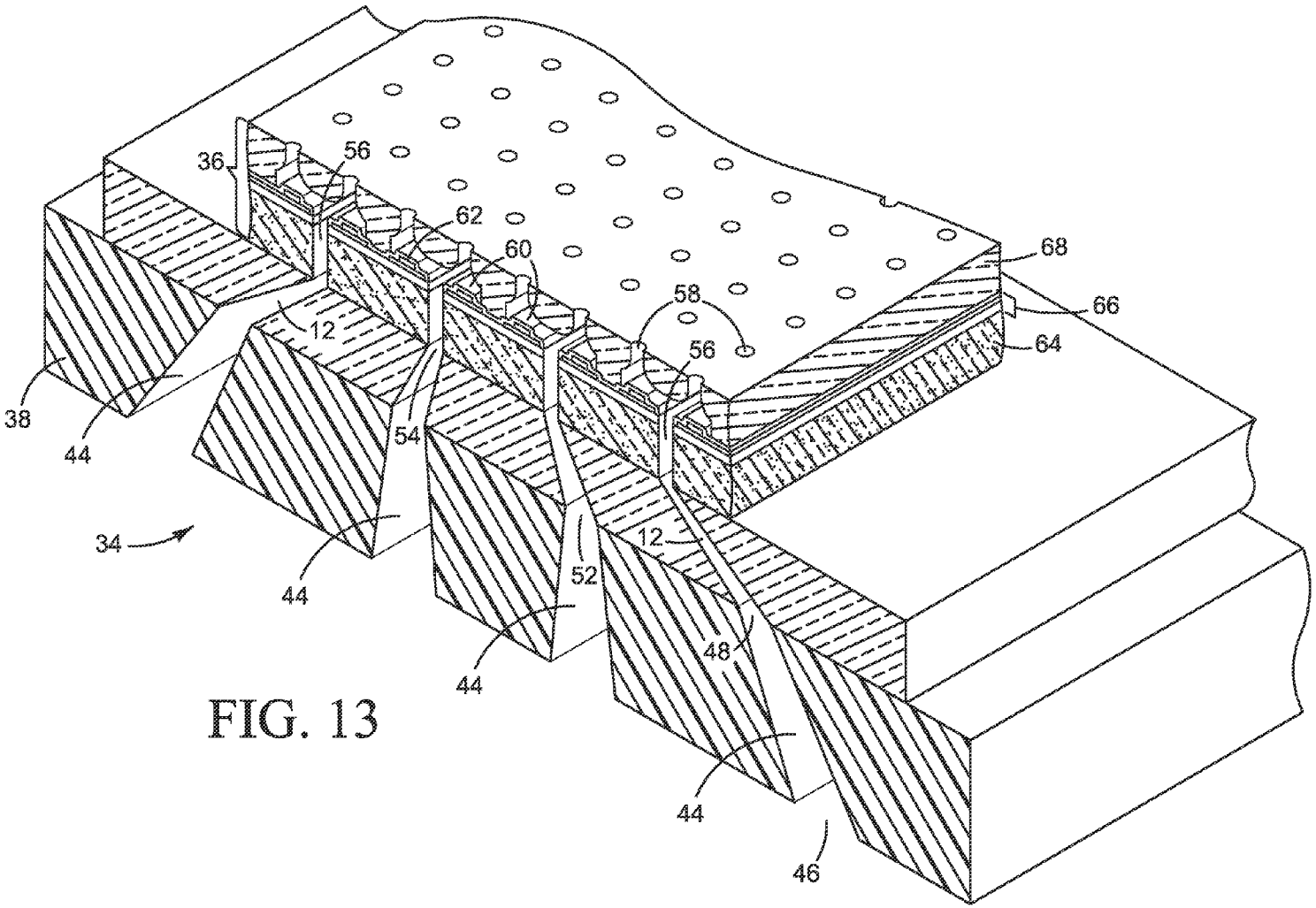

FIGS. 12 and 13 illustrate a printhead assembly 34 implementing one example of the new diagonal openings 12 in a glass interposer 14. FIGS. 12 and 13 depict similar structures in which printhead assembly 34 includes a printhead 36 bonded to a glass interposer 14 bonded to a molded plastic ink distribution manifold 38. FIG. 12 depicts a portion of a printhead 36 more generally while FIG. 13 depicts a portion of a printhead 36 in more detail specifically as a thermal inkjet printhead. Referring first to FIG. 12, printhead 36 is bonded to glass interposer 14 with a first adhesive 40 and interposer 14 is bonded to ink distribution manifold 38 with a second adhesive 42. (Adhesives 40 and 42 are omitted from FIG. 13 to better illustrate other parts of printhead assembly 34.) A photodefinable glass interposer 14 can be easily and inexpensively manufactured with surfaces much flatter than the comparatively large surface topography typical of a molded plastic part. Accordingly, lower aspect-ratio adhesive lines may be used at the printhead bond interface, as best seen by comparing the thinner first adhesive 40 at the silicon/glass interface between printhead 38 and interposer 14 to the thicker second adhesive 42 at the glass/plastic interface between interposer 14 and manifold 38.

Referring now to both FIGS. 12 and 13, ink is carried from manifold 38 to printhead 36 through an array of passages that grow smaller and more compact as the ink is channeled toward printhead 36. In the example shown, a set of fanned out passages 44 in manifold 38 carry ink from wider, loosely spaced inlets 46 to narrower, more tightly spaced outlets 48 at interposer 14. A set of fanned out ink slots 12 in glass interposer 14 carry ink from wider, less tightly spaced inlets 52 at manifold 38 to narrower, more tightly spaced outlets 54 at printhead 36. Uniformly shaped ink channels 56 in a printhead 36 carry ink to the ejection chambers where it is dispensed through an array of orifices 58. In the example shown in FIG. 13, each printhead ink channel 56 supplies ink to a pair of ejection chambers 60 each associated with a firing resistor 62 and orifice 58. Printhead ink channels 56 are formed in a substrate 64 underlying an integrated circuit (IC) structure 66 that includes firing resistors 62 and an orifice plate 68 formed on IC structure 66.

Figure 14:
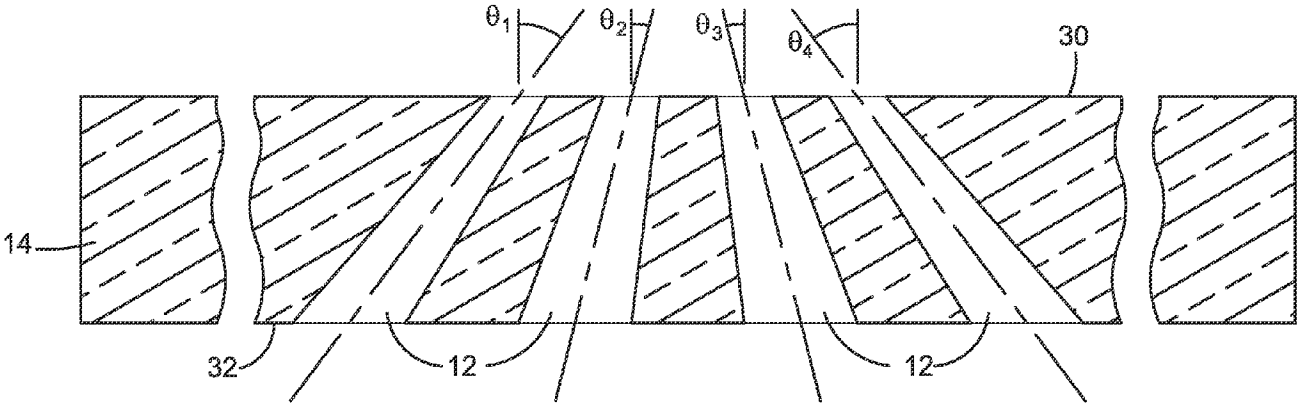
FIGS. 14 and 15 are details views of the interposer in the printhead of FIG. 14.
Figure 15:
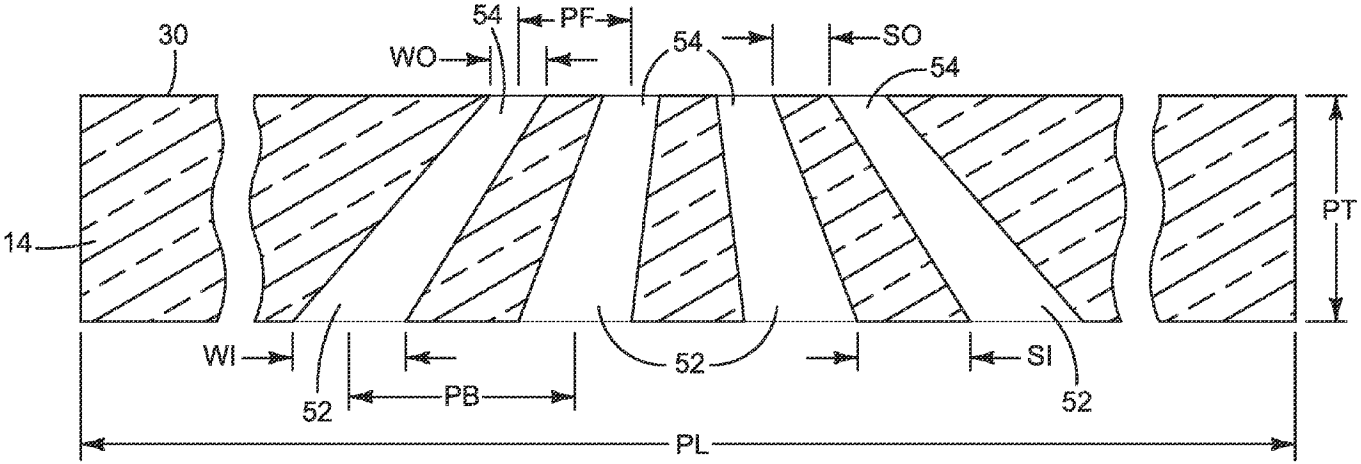

The development of exposure techniques that enable the fabrication of small, tightly spaced diagonal (fan out) slots in a glass interposer contributes significantly to the opportunity for further printhead die shrink. FIGS. 14 and 15 are detail views of interposer 14 from FIG. 12 showing one example configuration to support a printhead assembly that includes a new, smaller printhead such as might be used in the next generation of inkjet printer pens. Referring to FIGS. 14 and 15, the size WO and spacing SO of slot outlets 54 can now be reduced to 250 μm to deliver ink or other liquids to equally small and tightly spaced printhead channels 56 (FIG. 12) using a photodefinable glass interposer 14 with fan out slots 12. Testing indicates it is possible to form suitable diagonal slots 12 at tilt angles θ in the range of 5° to 50°. Accordingly, fan out ratios of 2:1 can be achieved across thin glass plates suitable for use as a print interposer 14. For example, to achieve a 2:1 fan out ratio for a 1 mm thick photodefinable glass plate 14 (PT=1 mm, PL=10 mm) with a center-to-center slot pitch PF of 500 μm at front surface 30 (width of outlet WO=250 μm and spacing between outlets SO=250 μm and a slot pitch PB of 1,000 μm at back surface 32 (width of inlet WI=500 μm and spacing between inlets SI=500 μm), tilt angles $\theta_1$=+50°, $\theta_2$=+20°, $\theta_3$=−20°, and $\theta_4$=−50° are required, well within the range of tilt angles possible with photodefinable glass interposer 14. Conventional glass mechanical machining methods, on the other hand, are not capable of producing these size and shape openings.

Figure 16:
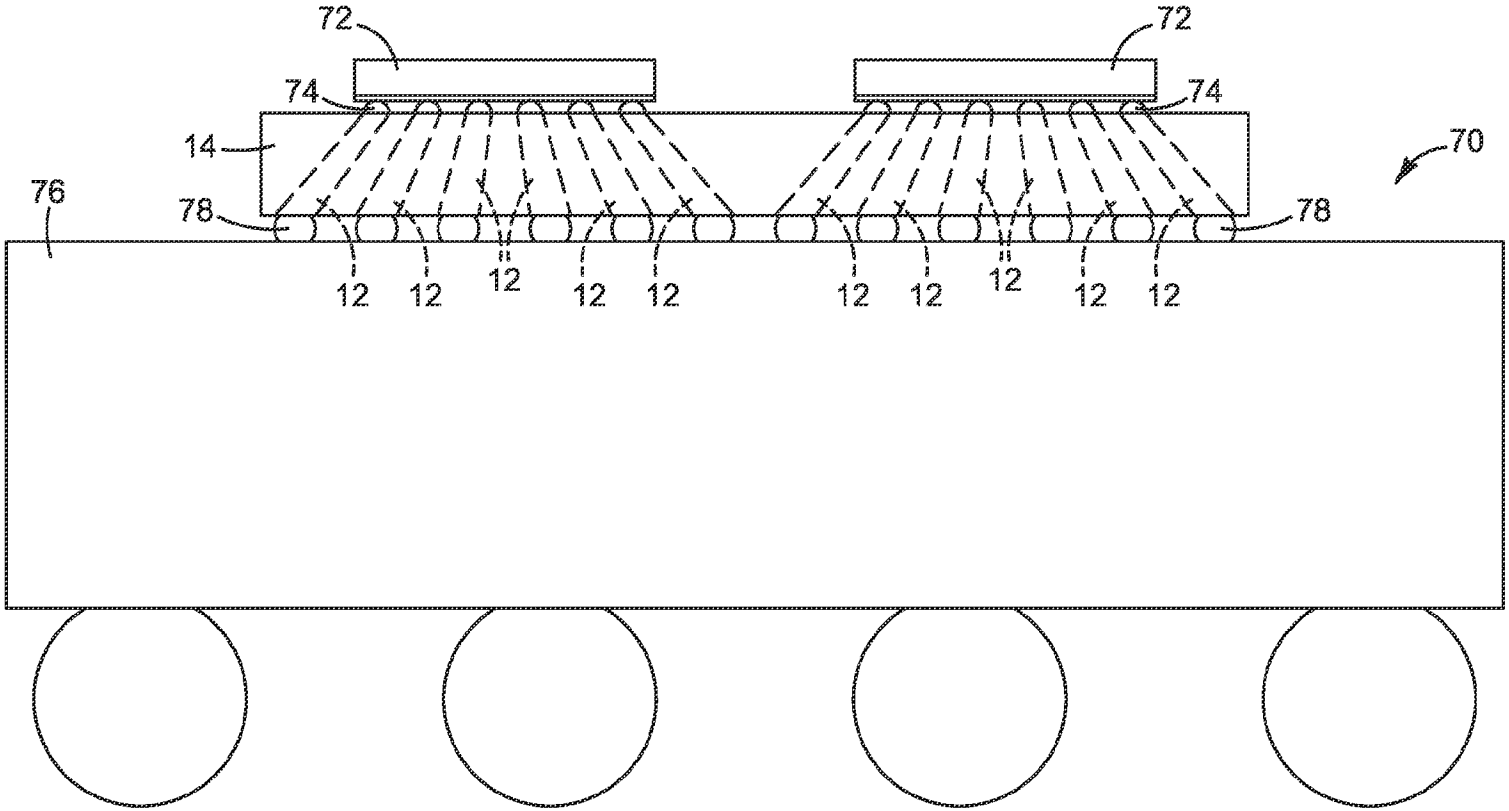
FIG. 16 illustrates an integrated circuit (IC) assembly implementing another example of the new diagonal openings in a photodefinable glass interposer.

FIG. 16 illustrates an integrated circuit (IC) assembly 70 implementing another example of the new diagonal openings 12 in a glass interposer 14. Referring to FIG. 16, IC assembly 70 includes a thin IC device 72 attached to a photodefinable glass interposer 14 through an array of first electrode bumps 74. Glass interposer 14 is attached to a plastic packaging substrate 76 through an array of second electrode bumps 78. The first and second electrode bumps 74, 78 are electrically connected through a corresponding array of conductor filled through vias 12 that fan out from a tighter spacing at IC device 72 and first electrode bumps 74 to a looser spacing at packaging substrate 76 and second electrode bumps 78.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A method, comprising:

concurrently forming a plurality of spaced nonparallel bundles of nonparallel rays; exposing part of a body of photodefinable glass to the plurality of nonparallel bundles of nonparallel rays, each bundle oriented diagonally to a surface of the body at an angle of 5° or greater measured with respect to a plane normal to the surface of the body; and removing some or all of the part of the body exposed to the plurality of nonparallel bundles of nonparallel rays to form a diagonal opening in the body.

2. The method of claim 1, wherein the body comprises a photodefinable glass plate, wherein each bundle is oriented diagonally to a surface of the plate at an angle in the range of 5-50° measured with respect to a plane normal to the surface of the plate and wherein the removing comprises removing some or all of the part of the glass plate exposed to the light beam to form a diagonal opening in the glass plate.

3. The method of claim 2, wherein a full thickness of the glass plate is exposed to the plurality of nonparallel bundles of nonparallel rays, wherein each of the plurality of nonparallel bundles of nonparallel rays are expanding and wherein the removing comprises removing the part of the glass plate exposed to the plurality of nonparallel bundles of nonparallel rays to form openings through the glass plate, each of the openings expanding from a smaller dimension at one surface of the plate to a larger dimension at an opposite surface of the plate.

4. The method of claim 1, where the removing comprises:

heating the glass body to change the composition of the part of the glass body exposed to the light beam; and then etching the glass body to remove some or all of the changed part of the glass body.

5. The method of claim 1, wherein the nonparallel bundles of nonparallel rays diverge through the body.

6. The method of claim 1, wherein the nonparallel bundles of nonparallel rays converge through the body.

7. The method of claim 1 comprising directing light through an optical arrangement to concurrently form the plurality of spaced nonparallel bundles of nonparallel rays, the optical arrangement being selected from a group of optical arrangements consisting of: (1) a phase shifting mask; (2) a diffraction grating; (3) a two-sided mask and lenses; (4) a negative cylindrical lens and a mask; (5) a positive cylindrical lens and a mask; and (6) a mask, a negative lens and a positive lens.

8. A method, comprising: concurrently forming a plurality of spaced nonparallel bundles of nonparallel rays; exposing part of a body of photodefinable glass plate to the plurality of nonparallel bundles of nonparallel rays, each of the plurality of nonparallel bundles of nonparallel rays being oriented diagonally to a surface of the plate at a different angle within the range of 5-50° measured with respect to a plane normal to the surface of the plate, and removing some or all of each part of the glass plate exposed to the plurality of nonparallel bundles of nonparallel rays to form multiple openings through the glass plate, each of the multiple openings being oriented diagonally to the surface of the plate at a different angle.

9. The method of claim 8, wherein each of the plurality of nonparallel bundles of nonparallel rays is expanding and wherein the removing comprises removing some or all of each part of the glass plate exposed to the plurality of nonparallel bundles of nonparallel rays to form multiple openings through the glass plate, each of the multiple openings being oriented diagonally to the surface of the plate at a different angle and expanding from a smaller dimension at one surface of the plate to a larger dimension at an opposite surface of the plate.

10. The method of claim 8, wherein each of the plurality of nonparallel bundles of nonparallel rays is contracting; and wherein the removing comprises removing some or all of each part of the glass plate exposed to the plurality of nonparallel bundles of nonparallel rays to form multiple openings through the glass plate, each of the multiple openings being oriented diagonally to the surface of the plate at a different angle and contracting from a larger dimension at one surface of the plate to a smaller dimension at an opposite surface of the plate.

* * * * *